US005584106A

United States Patent [19]

Anscher

[11] Patent Number: 5,584,106

[45] **Date of Patent: *Dec. 17, 1996**

[54] HELMET STRAP BUCKLE ASSEMBLY

[75] Inventor: Joseph Anscher, Muttontown, N.Y.

[73] Assignee: National Molding Corporation, Farmingdale, N.Y.

[ * ] Notice: The term of this patent shall not extend beyond the expiration date of Pat. No. 5,459,910.

[21] Appl. No.: 510,541

[22] Filed: Aug. 2, 1995

Related U.S. Application Data

[63] Continuation-in-part of Ser. No. 300,167, Sep. 12, 1994, Pat. No. 5,459,910.

[51] Int. Cl.[6] ..... A44B 11/00

[52] U.S. Cl. ..... 24/625; 24/615; 24/634

[58] Field of Search ..... 24/625, 615, 616, 24/634, 630, 607, 326, 324, 585, 518, 170, 200; 2/421; 297/464, 467

[56] References Cited

U.S. PATENT DOCUMENTS

| | | | |
|---|---|---|---|
| 1,696,586 | 12/1928 | Simons | 24/324 |
| 3,262,169 | 7/1966 | Jantzen | 24/634 |
| 4,150,464 | 4/1979 | Tracy | 24/615 |
| 4,712,280 | 12/1987 | Fildan | 24/615 |
| 4,793,032 | 12/1988 | Crowle . | |
| 4,825,515 | 5/1989 | Wolterstorff, Jr. | 24/625 |
| 4,864,700 | 9/1989 | Kasai | 24/625 |
| 5,077,839 | 1/1992 | Keller . | |
| 5,131,122 | 7/1992 | Lavato | 24/625 |
| 5,291,641 | 3/1994 | Morino | 24/625 |
| 5,319,836 | 6/1994 | Ida | 24/625 |

*Primary Examiner*—Victor N. Sakran

[57] ABSTRACT

A buckle assembly for releasably connecting a first strap to a second strap. The buckle assembly includes a male clasp and a female. The male clasp frictionally engages the first strap with row of teeth along a strap bar. A planar shield on the male clasp covers the strap bar to provide a pleasing aesthetic appearance. The female buckle engages the second strap and can be readily connected and disconnected from the male strap with a single hand.

13 Claims, 3 Drawing Sheets

HELMET STRAP BUCKLE ASSEMBLY

CROSS REFERENCE TO RELATED APPLICATION

This application is a continuation-in-part of U.S. application Ser. No. 08/300,167 filed on Sep. 2, 1994, now U.S. Pat. No. 5,459,910.

BACKGROUND OF THE INVENTION

1. Field of the Invention

The present invention relates to helmet strap buckle assembly. More particularly, it relates to a helmet strap buckle assembly that allows a chin strap to be adjusted and coupled to protective head-gear to secure it to a wearer's head.

2. The Prior Art

A variety of strap and buckle assemblies are known for securing protective head-gear, such as a helmet, to a wearer's head. However, these devices have numerous drawbacks which render them difficult to operate and lowers the overall comfort level. For example, it may be difficult to adjust the length of the various straps and furthermore it may be difficult to connect or disconnect the buckle assembly.

One example of a prior art buckle is U.S. Pat. No. 5,077,839 to Keller. As can be most easily seen in FIG. 2, helmet straps 26 and 28 must each be independently adjusted in order to properly position the buckle approximately below the ear for each different individual. In addition, FIG. 3A shows the buckle connected together, while FIG. 3 shows the buckle disconnected. It will be readily apparent that element 36 must be held in place with one hand, while an upward force is exerted on part 22 in order to disengage them. Using two hands to release the buckle is quite awkward as the buckle resides generally below one of the wearer's ears which is conveniently accessible by the hand on that side of the body only.

It would therefore be desirably to provide a buckle assembly which can be easily adjusted to fit a wide variety of wearers and which can be connected and disconnected with one hand.

SUMMARY OF THE INVENTION

It is therefore an object of the present invention to overcome the drawbacks of the prior art and to provide a helmet strap buckle assembly that can be easily adjusted to accommodate a large variety of wearers.

It is a further object of the present invention to provide a helmet strap buckle assembly that can be readily connected and disconnected.

These and other related objects are achieved according to the invention by a buckle assembly for releasably connecting an adjustable length chin strap to a mid-portion of a helmet strap for securing a protective helmet to a wearer's head. The buckle assembly includes a male clasp and a female buckle. The male clasp has a base member and a rectilinear strap-engaging bar connected to the base member including means for frictionally engaging the helmet strap. An arcuate strap-retaining bar is connected to the rectilinear strap-engaging bar to form an openings therebetween. The helmet retention strap is looped around the rectilinear strap-engaging bar and extends through the opening. A planar shield extends from the base member in parallel spaced relation to the straps bars for covering the bars. The female buckle is connected to the adjustable length chin strap for releasably connecting to the male clasp.

The means for frictionally engaging the helmet strap comprises teeth for penetrating the looped helmet strap, so that the helmet is prevented from rolling forward off the wearers head upon impact. The base member includes two spaced-apart opposite walls disposed perpendicular to and connected to the shield. The strap-engaging bar extends between the two spaced opposite walls. The strap-engaging bar is rectilinear with a rectangular cross-section including four surfaces. The teeth are disposed on one of the four surfaces. The teeth are aligned in a row along one of the surfaces. One of the surfaces is a downwardly-facing surface which faces away from the strap-retaining bar. Another surface is an inwardly-facing surface which faces away from the shield. The teeth are selectively disposed on either the downwardly-facing surface or the inwardly-facing surface. The male clasp further includes two flexible arm members that extend outwardly from the base member, generally away from the shield and the bars. A locking tab is mounted on each of the arm members. An axially-extending guide element is disposed between the arm members.

The female buckle consists of a hollow body with two spaced opposite side walls, an opening for removably receiving the male clasp and a locking slot extending through each side wall for providing access to the flexible arm members and for engaging the locking tabs. Each locking tab snaps into the respective locking slot to engage the side wall upon full insertion of said male clasp. The engaging relationship between the male clasp and the female buckle is such that the release tabs seat in respective locking slots to provide a latching relationship therebetween. The male clasp is unlatched by depressing the locking tabs inwardly of the corresponding locking slots, a sufficient distance to pass beyond the side walls. The female buckle further includes guide means extending lengthwise of the hollow body complementary to the guide element. The arm members are adapted to be axially telescoped into the hollow body with the openings receiving by snap action the locking tabs carried by the flexible arm members.

Each of the release tabs includes an exterior surface that extends into the locking slot when the clasp is fully inserted into the main buckle. These exterior surfaces are configured and dimensioned so that at least a portion of each of the exterior surfaces faces away from the corresponding opening. In this manner, pressure on the portions while depressing the release tabs propels the clasp outwardly of the opening.

These exterior surfaces are adapted to be engaged by a wearer's upturned hand just below an ear, to snap and propel the clasp away from the hand, upwardly toward the helmet. The female buckle includes a strap retaining assembly disposed opposite the opening for connecting to the chin strap. The hollow body and the male clasp are disposed within a common plane upon full engagement, with the strap retaining assembly curving away from the common plane and adapted to conform to the shape of the wearer's jaw.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Referring now in detail to the drawings and in particular FIGS. 1, 2, 3A, 3B, 4 and 5, there is shown a male clasp 20 which slidingly engages a helmet retention strap 21. Male clasp 20 is formed from a base member 25, which supports flexible arms 22*a* and 22*b*, locking tabs 32*a* and 32*b*, and spaced opposite side walls 23*a* and 23*b*. A guide arm 24 is disposed between arms 22*a* and 22*b*. Arms 22*a*, 22*b* and 24 releasably guide and connect male clasp 20 to the female buckle, as will be discussed in greater detail below.

Figure 1:
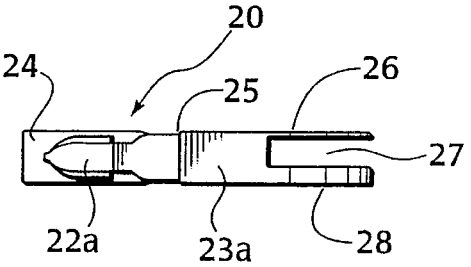
FIG. 1 is a right side elevational view of a male clasp of the buckle assembly according to the invention.
Figure 2:
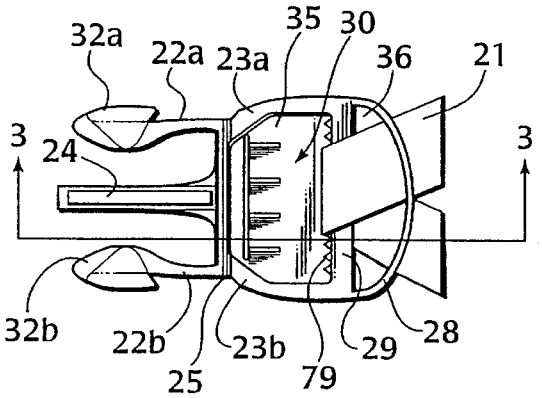
FIG. 2 is a back side elevational view of the male clasp.
Figure 3A:
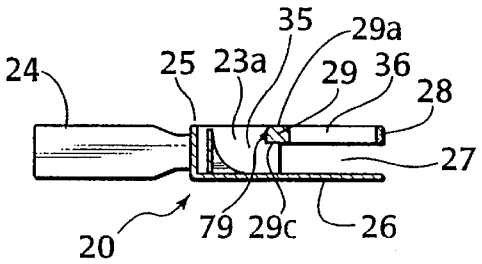
FIG. 3A is a cross-sectional view of the clasp taken along the line 3—3 from FIG. 2.
Figure 3B:
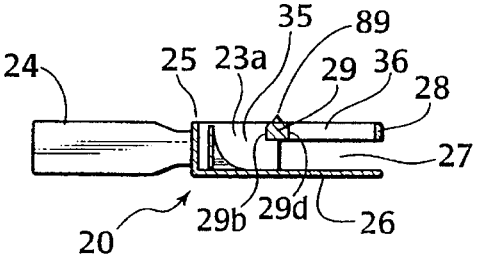
FIG. 3B is a cross-sectional view of an alternate embodiment of the clasp taken along the line 3—3 from FIG. 2.
Figure 4:
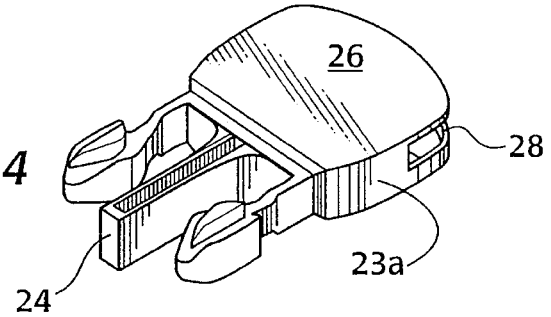
FIG. 4 is a front, right, bottom perspective view of the male clasp.
Figure 5:
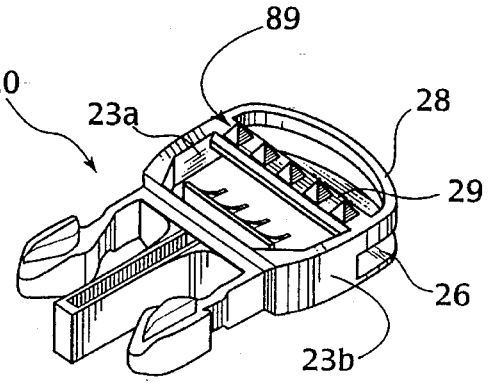
FIG. 5 is a back, left, bottom perspective view of the male clasp.

A shield 26 extends from base member 25, away from arms 22*a*, 22*b* and 24. Walls 23*a* and 23*b* are disposed perpendicular to shield 26. Walls 23*a* and 23*b* maintained shield 26 in parallel spaced relation to an arcuate bar 28 and a rectilinear bar 29. A slot 27 is formed between sheild 26 and arcuate bar 28, as can be seen in FIGS. 1 and 3. A first aperture 35 is located between side walls 23*a* and 23*b*, adjacent shield 26 and in communication with slot 27. A second semi-circular aperture 36 is formed between arcuate bar 28 and rectilinear bar 29, and is also in communication with slot 27. Aperture 36 may also be fan-shaped. As can be seen in FIGS. 3A and 3B, rectilinear bar 29 has a rectangular or square cross-section with sides 29*a*, 29*b*, 29*c* and 29*d*. A surface 29*a* faces away from shield 26 and surface 29*b* faces away from arcuate bar 28. FIGS. 2 and 3A show a row of teeth 79 disposed on surface 29*b*. Alternatively, FIGS. 3B and 5 show a row of teeth 89 disposed on surface 29.

Figure 8:
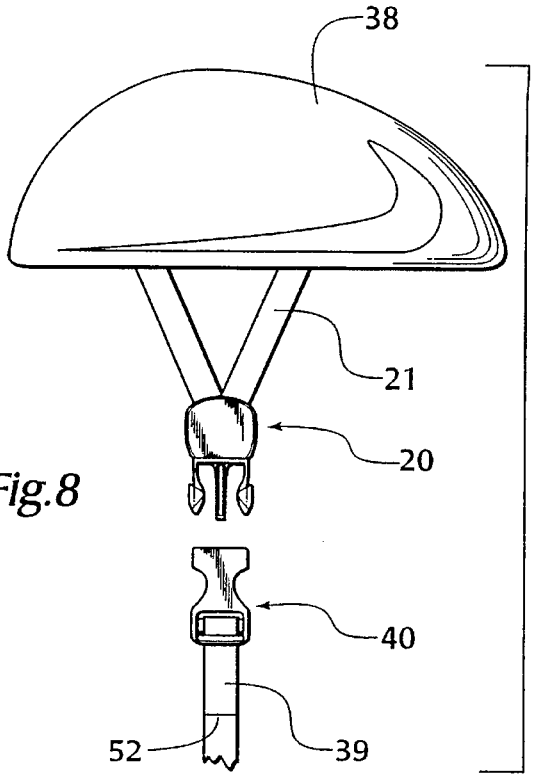
FIG. 8 is a front side elevational view of the buckle assembly in conjunction with their corresponding straps and a helmet.

As can be seen in FIGS. 2 and 8, helmet retention strap 21 has two ends which are connected to helmet 38. The central region of strap 21, between the two ends thereof, forms a loop. This loop passes into slot 27, through first aperture 35, around rectilinear bar 29, through second semi-circular aperture 36 and back through slot 27. Strap 21 is slackened to adjust its position relative to rectilinear bar 29. Once the user selects the proper position, i.e. where male clasp 20 is comfortably positioned below the ear, strap 21 is tightened to engage teeth 79 or 89. Teeth 79 or 89 lock strap 21 in position along male clasp 20 which prevents the helmet from rolling forward upon impact. Shield 26 covers the engagement between strap 21 and bars 28 and 29 to provide an aesthetic appearance.

As can be seen in FIG. 8, helmet 38 and strap 21 form a triangular opening with male clasp 20 defining the bottom corner of the triangle. The wearer'ear is located within the triangular opening, with male clasp 20 being adjusted to a position centrally below the wearer's ear. The shape of the triangular opening can be varied to accommodate a large variety of wearers. Upon proper adjustment, the tension exerted by the chin strap 39 via female buckle 40 is properly and evenly distributed to both points where strap 39 is connected to helmet 38. In other words, neither side of strap 21 will have slack, both sides will be subject to approximately the same tensile forces. This not only makes helmet 38 more comfortable, but will keep it intact in case of a collision. The opposite side of the helmet has the chin strap coupled to an additional helmet strap.

Figure 6:
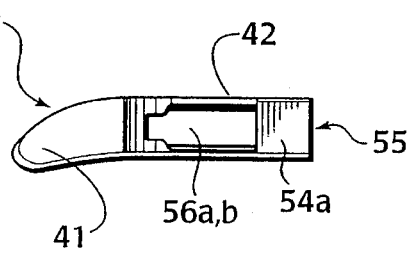
FIG. 6 is a right side elevational view of a female buckle assembly according to the invention.
Figure 7A:
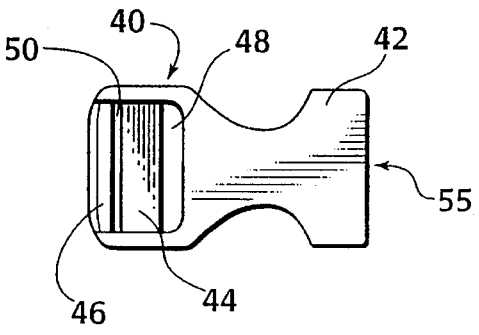
FIG. 7*a* is a front side elevational view of the female buckle.
Figure 7B:
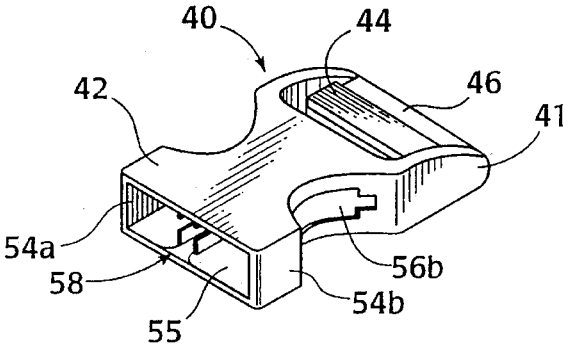
FIG. 7*b* is a front, left, top perspective view of the female buckle.

FIG. 6, 7*a* and 7*b* show a female buckle 40, having a curved end 41 and a hollow body 42. A main opening 55, equipped with a guide rail 58, faces male clasp 20. Two locking slots 56*a* and 56*b* are located, respectively, in opposite side walls 54*a* and 56*b*. Locking slots 56*a* and 56*b* receive tabs 32*a* and 32*b* upon full telescopic insertion of male clasp 20 into female buckle 40. Curved end 41 consists of an inner strap retaining bar 44 and an outer strap retaining bar 46. An inner slot 48 is disposed between inner strap retaining bar 44 and hollow body 42. An outer slot 50 is formed between inner strap retaining bar 44 and outer strap retaining bar 46. An adjustable chin strap 39 engages the strap retaining bars 44 and 46, as can be seen in FIG. 8.

Referring again to FIG. 7*a*, the adjustable chin strap passes underneath strap retaining bar 44 and 46 and passes through inner slot 48 out of the page. The strap is then looped over inner strap retaining bar 44 and passes through outer slot 50, down into the page. A free end 52 of the adjustable chin strap is then located exteriorly of the central section thereof so that it is accessible for adjustment by the wearer. Pulling downwardly on end 52 causes the chin strap to tighten up, whereas sliding end 52 upwardly through slots 50 and 48 serves to loosen the chin strap.

Figure 9A:
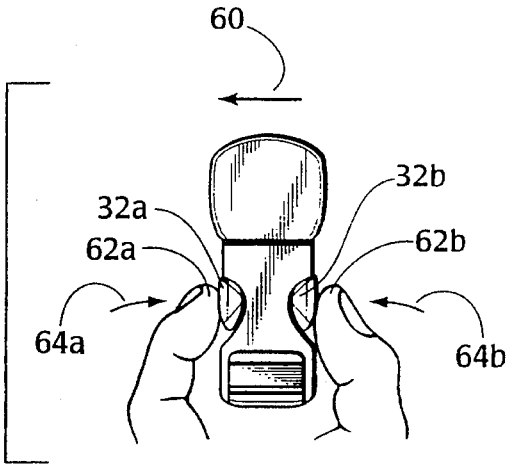
FIG. 9*a* is a front side elevational view of the buckle assembly about to be released.
Figure 9B:
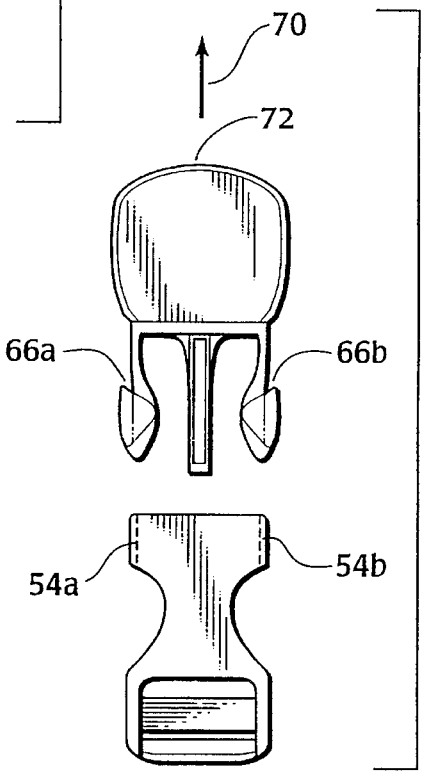
FIG. 9*b* is a front side elevational view of the disconnected buckle assembly.

FIG. 9*a* is intended to show the buckle assembly adjacent the left side of the users's head, just below the ear, with arrow 60 pointing toward the front of the wearer's head. The user reaches upon with the thumb 62*b* and forefinger 62*a* of the left hand and places them adjacent flexible tabs 32*b* and 32*a*, respectively. Fingers 62*a* and 62*b* simultaneously press inwardly, in the directions indicated by arrows 64*a* and 64*b*, respectively. Once the leading edges 66*a* and 66*b* of tabs 32*a* and 32*b* clear side walls 54*a* and 54*b*, shown in dotted line in FIG. 9*b*, clasp 20 is propelled outwardly from female buckle 40. Since the female buckle is on the bottom, male clasp 20 is able to snap upwardly away from the wearer's upturned closed hand. As can be appreciated, as locking tabs 32*a* and 32*b* are forced inwardly, in directions 64*a* and 64*b*, respectively, the pressure by fingers 62*a* and 62*b* is directed at least partially in direction 70 to forcibly propel male clasp 20 out of female buckle 40.

To re-attached female buckle 40 to male clasp 20, the wearer grasps female buckle 40 with the thumb and middle finger, for example, and brings it into alignment with male clasp 20. Once guide arm 24 is aligned with guide rail 58, the free forefinger can extend upwardly and hold male clasp 20 in place at point 72. Male clasp 20 can now be slid upwardly in direction 70 while male clasp 20 remains stationary, until they are fully engaged with each other.

While only several embodiments of the present invention have been shown and described, it is to be understood that many changes and modifications may be made thereunto without departing from the spirit and scope of the invention as defined in the appended claims.

What is claimed is:

1. A buckle assembly for releasably connecting an adjustable-length chin strap to a mid-portion of a helmet strap for securing a protective helmet to a wearer's head, the helmet strap having two ends connected to the helmet at two spaced connection points, the buckle assembly comprising:

a male clasp including;

(a) a base member;

(b) a strap-engaging bar connected to said base member and including means for frictionally engaging the helmet strap;

(c) a strap-retaining bar having ends connected to said strap-engaging bar and a central section spaced from said strap-engaging bar to form an opening therebetween sufficient for the helmet strap to slide therethrough, said helmet strap extending down from one of said connection points, between said shield and said strap bars, around said strap-engaging bar, through the opening, and up to the other of said connection points; and (d) a planar shield extending from said base member in parallel spaced relation to said strap bars for covering said bars; and a female buckle connected to the adjustable-length chin strap for releasably connecting to said male clasp, and wherein said means for frictionally engaging the helmet strap engages and locks said male clasp in position with respect to the helmet strap.

2. The device according to claim 1, wherein said means for frictionally engaging comprises teeth for penetrating the looped helmet strap so that the helmet is prevented from rolling forward off the wearer's head upon impact.

3. The device according to claim 2, wherein said base member includes two spaced apart opposite walls disposed perpendicular to and connected to said shield;

wherein said strap-engaging bar extends between said two spaced opposite walls.

4. The device according to claim 3, wherein said strap-engaging bar is rectilinear with a rectangular cross-section including four surfaces.

5. The device according to claim 4, wherein said teeth are disposed on one of said four surfaces.

6. The device according to claim 5, wherein said teeth are aligned in a row along one of said four surfaces.

7. The device according to claim 4, wherein one of said four surfaces in a downwardly-facing surface which faces away from said strap-retaining bar, said teeth are disposed on said downwardly-facing surface.

8. The device according to claim 4, wherein one of said four surfaces is an inwardly-facing surface which faces away from said shield, said teeth are disposed on said inwardly-facing surface.

9. The device according to claim 3, wherein said male clasp includes:

two flexible arm members extending outwardly from said base member generally away from said shield and said bars;

a locking tab disposed on the end of each of said arm members; and an axially-extending guide element disposed between said arm member.

10. The device according to claim 9, wherein said female buckle comprises a hollow body with two sidewalls, an opening for removably receiving said male clasp, a locking slot extending through each sidewall for providing access to said unlocking tabs and guide means extending lengthwise of the hollow body and complementary to said guide element and spaced inwardly from the opening for cooperative sliding engagement with the guide element during telescopic association therewith;

wherein each flexible arm member biases the corresponding locking tab so that said locking tab snaps into the respective locking slot to engage the sidewall upon full insertion of said male clasp;

wherein the engaging relationship between said male clasp and said female buckle is such that said locking tabs seat in respective locking slots to provide a latching relationship therebetween and said male clasp is unlatched by depressing said locking tabs inwardly of the corresponding locking slots a sufficient distance so that said locking tabs pass beyond said sidewalls.

11. The device according to claim 10, wherein said flexible arm members are adapted to be axially telescoped into the hollow body of said female buckle with the openings receiving by snap action the locking tabs carried by said flexible arm members.

12. The device according to claim 11, wherein each of said locking tabs includes an exterior surface that extends into the locking slot in locking relationship when the clasp is fully inserted in said main buckle; and said exterior surfaces are configured and dimensioned so that at least a portion of each of said exterior surfaces faces away from the corresponding opening whereby pressure on the portions while depressing the locking tabs propel the clasp outwardly of the opening;

wherein said exterior surfaces are adapted to be engaged by a wearer's upturned hand just below an ear to snap and propel the clasp away from the hand upwardly toward the helmet.

13. The device according to claim 12, wherein said female buckle includes a strap retaining assembly disposed opposite the opening for connecting to the chin strap; and wherein said hollow body and said male clasp are disposed within a common plane upon full engagement, with said strap retaining assembly curving away from said common plane and adapted to conform to the shape of the wearer's jaw.

* * * * *